US005363665A

United States Patent [19]

Sundman

[11] Patent Number: 5,363,665

[45] Date of Patent: Nov. 15, 1994

[54] HAND PUMP FOR EVACUATING AND CHARGING A REFRIGERATING SYSTEM

[75] Inventor: Kurt Sundman, Spånga, Sweden

[73] Assignee: Aktiebolaget Electrolux, Sweden

[21] Appl. No.: 118,416

[22] Filed: Sep. 8, 1993

[30] Foreign Application Priority Data

Sep. 10, 1992 [SE] Sweden ..... 9202606

[51] Int. Cl.[5] ..... F25B 49/00

[52] U.S. Cl. ..... 62/125; 62/292; 417/63; 417/544

[58] Field of Search ..... 62/292, 77, 129, 126; 417/544, 63

[56] References Cited

U.S. PATENT DOCUMENTS 1,705,401 3/1929 Grimley ..... 417/544
4,441,330 4/1984 Lower et al. ..... 62/292
4,698,983 10/1987 Hechavarria ..... 62/292

*Primary Examiner*—John M. Sollecito
*Attorney, Agent, or Firm*—Pearne, Gordon, McCoy & Granger

[57] ABSTRACT

A device for evacuating and charging refrigerant in a refrigerant circuit (64) includes a hand pump to evacuate the circuit. The pump has a pump cylinder (10), in which a pump piston (12) is movable to and fro by a piston rod (16) which has a pump handle (14) mounted thereon. The circuit is charged with refrigerant from a container (18), which extends in the longitudinal direction of the pump cylinder (10) and is fastened to the cylinder.

5 Claims, 1 Drawing Sheet

HAND PUMP FOR EVACUATING AND CHARGING A REFRIGERATING SYSTEM

BACKGROUND OF THE INVENTION

The invention refers to a device for evacuating and charging refrigerant in a refrigerant circuit comprising a pump to evacuate the circuit and a container with refrigerant which is conducted into the circuit by self pressure.

Such a known device, which frequently is used when a refrigerating compressor in a domestic refrigerator is replaced, comprises an electrically operated pump, by which the refrigerant in the circuit is evacuated before the defective compressor is removed from the circuit. When the new compressor has been connected to the circuit, the circuit is evacuated once more by the pump. Thereafter, the circuit is refilled with refrigerant from the container. In the known device the container communicates with a glass tube, in which one can observe the level of the refrigerant in the container. Behind the glass tube there is a scale, on which one can see how many grams of refrigerant there is in the container. The container can hold refrigerant for charging about five refrigerant circuits. In the known device the container can be mounted on the pump.

The known device is relatively expensive since the pump is electrically operated. It is furthermore cumbersome to handle when the pump is built into a box, which shows a relatively small height but a relatively large extension in side direction. Alternatively, in order that one shall get a good accuracy of reading on the scale, the container has a relatively large extension in height direction but a relatively small extension in side direction.

SUMMARY OF THE INVENTION

It is an object of the present invention to improve the known device so that it will be easier to handle, that it takes smaller space, that the accuracy of reading on the scale becomes good and that it becomes cheaper to produce.

This object is obtained by the device according to the invention wherein that the pump is constituted by a hand pump having a pump cylinder, in which a pump piston is arranged to be moved to and fro by a piston rod by means of a handle for manual pumping and wherein container extends in the longitudinal direction of the pump cylinder and is fastened to the cylinder.

BRIEF DESCRIPTION OF THE DRAWINGS

An embodiment of a device according to the invention is described below in connection to the enclosed drawings, where.

DETAILED DESCRIPTION OF THE PREFERRED EMBODIMENT

Figure 1:
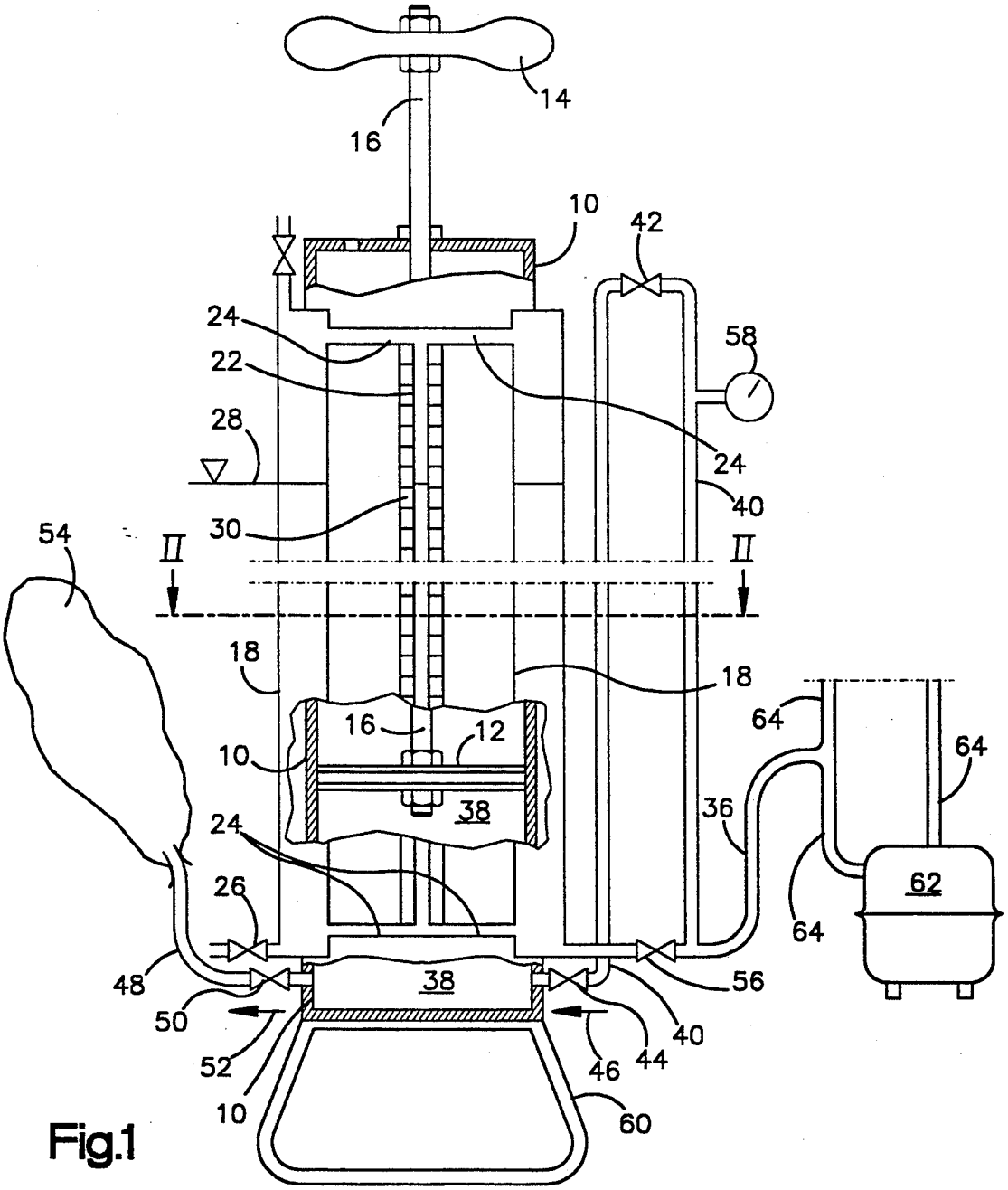
FIG. 1 shows a side view of a pump with a container, parts of the container and the pump having been cut out so that an upper part, a middle part and a lower part of a pump cylinder are shown in a longitudinal sectional view.
Figure 2:
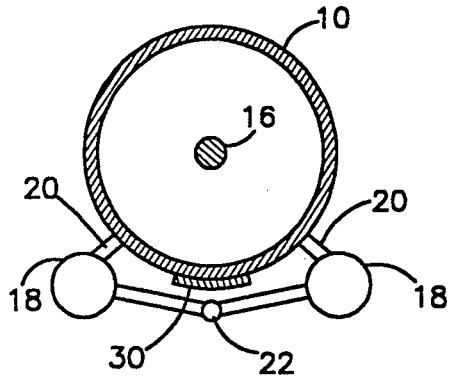
FIG. 2 shows a sectional view according to the marking II—II in FIG. 1.

Referring to FIG. 1 numeral 10 designates a cylinder, in which a piston 12 is manually drivable to and fro by a handle 14, which is fastened to a rod 16, which connects the handle with the piston 12. A closed container in the shape of two tubes 18 is fastened to the cylinder 10 by holders 20. The tubes 18 communicate with each other and with a glass tube 22 via pipes 24. The container is filled with refrigerant through a valve 26. The level 28 of the refrigerant in the container is visible through the tube 22, which has a measuring scale 30 as background. The quantity of refrigerant in the container can be read on the scale 30

The device shows a tube 36, which is connected to a pump chamber 38 through a conduit 40, which is provided with a cutoff valve 42 and a nonreturn valve 44, the flow direction of which being indicated by the arrow 46. The pump chamber 38 shows a discharge tube 48, which is provided with a nonreturn valve 50, the flow direction of which being indicated by the arrow 52. The tube 48 is provided with a flexible bladder 54 for collecting refrigerant. The container 18 has an outlet, which is connected to the tube 36 via a cut-off valve 56. The tube 40 is provided with a pressure gauge 58 displaying the pressure in the tube 40. The device is at the bottom provided with a support 60, into which the person who pumps with the handle 14 can put a foot to hold the pump against a basis when pumping.

When e.g. a refrigerating compressor 62, which is part of a refrigerant circuit 64 of a domestic refrigerator, is to be replaced, the following takes place: The tube 36 is connected to the circuit 64. The valve 56 is closed. The valve 42 is opened, at which point the refrigerant, first by self pressure, will flow through the tubes 36 and 40, through the pump chamber 38 and through the tube 48 into the collecting bladder 54. When the pressure in the circuit 64 has reached atmospheric pressure, the circuit 64 is further evacuated by pumping with the handle 14 until a desired vacuum is read on the gauge 58.

The circuit 64, which now is emptied of refrigerant, can now be opened, after which the compressor is replaced with a new compressor and the circuit 64 is sealed. Thereafter air which has come into the circuit is evacuated to a desired vacuum level by pumping with the pump. Then, the valve 42 is closed and the valve 56 is opened for a period to allow a a desired quantity of refrigerant to flow by self pressure from the container or tubes 18 into the circuit 64 through the tube 36. Then the tube 36 is removed from the circuit 64, which now is charged with new refrigerant.

I claim:

1. Device for evacuating and charging refrigerant in a refrigerant circuit (64) comprising a pump to evacuate the circuit and a container (18) with refrigerant which is conducted into the circuit by self pressure, wherein the pump is constituted by a hand pump having a pump cylinder (10) in which a pump piston (12) is arranged to be moved to and fro by a piston rod (16) by means of a handle (14) for manual pumping, said container (18) extending in a longitudinal direction of the pump cylinder (10) and is fastened to the cylinder, a gauge (22) being arranged in parallel with the container (18) and communicating with said container, said gauge (22) including scale means (30) to allow refrigerant level within said container (18) to be determined.

2. Device according to claim 1, wherein the pump is a single-acting type pump having a pump chamber (38) located between the piston (12) and a bottom of the cylinder (10).

3. Device according to claim 1 or 2, wherein a bottom of the pump is provided with a support (60) into which a person who pumps with said handle can put a foot for holding the pump against a basis.

4. Device according to claim 1 or 2, wherein the container comprises two cylindrical tubes (18), said tubes extending parallel to each other and said glass gauge (22), which is arranged between the tubes (18), the tubes (18) and the glass gauge (22) being in fluid communication with each other.

5. Device according to claim 3, wherein the container comprises two cylindrical tubes (18), said tubes extending parallel to each other and said glass gauge (22), which is arranged between the tubes (18), the tubes (18) and the glass gauge (22) being in fluid communication with each other.

* * * * *